US009511968B2

(12) United States Patent
Malmqvist

(10) Patent No.: US 9,511,968 B2
(45) Date of Patent: Dec. 6, 2016

(54) REEL-UP AND A METHOD FOR WINDING INTO A ROLL A PAPER WEB AND FOR STARTING A NEW ROLL

(71) Applicant: Valmet Aktiebolag, Sundsvall (SE)

(72) Inventor: Per-Olof Malmqvist, Karlstad (SE)

(73) Assignee: Valmet Aktiebolag, Sundsvall (SE)

( * ) Notice: Subject to any disclaimer, the term of this patent is extended or adjusted under 35 U.S.C. 154(b) by 0 days.

(21) Appl. No.: 14/909,228

(22) PCT Filed: Jul. 15, 2014

(86) PCT No.: PCT/SE2014/050893
§ 371 (c)(1),
(2) Date: Feb. 1, 2016

(87) PCT Pub. No.: WO2015/034413
PCT Pub. Date: Mar. 12, 2015

(65) Prior Publication Data

US 2016/0185548 A1 Jun. 30, 2016

(30) Foreign Application Priority Data

Sep. 9, 2013 (SE) ..... 1351034

(51) Int. Cl.
*B65H 19/28* (2006.01)
*B65H 19/26* (2006.01)
*B65H 18/22* (2006.01)

(52) U.S. Cl.
CPC ..... *B65H 19/265* (2013.01); *B65H 18/22* (2013.01); *B65H 19/283* (2013.01); *B65H 19/286* (2013.01);
(Continued)

(58) Field of Classification Search
CPC ..... B65H 19/28; B65H 19/286; B65H 2301/51534; B65H 18/22
See application file for complete search history.

(56) References Cited

U.S. PATENT DOCUMENTS 3,743,199 A 7/1973 Karr et al.
4,649,074 A 3/1987 Borel
(Continued)

FOREIGN PATENT DOCUMENTS

CN 1129023 A 8/1996
CN 1261856 A 8/2000
(Continued)

OTHER PUBLICATIONS

International Searching Authority, International Search Report and Written Opinion for International Application No. PCT/SE2014/050893, Dec. 4, 2014, 10 pages, Swedish Patent and Registration Office, Sweden.
(Continued)

*Primary Examiner* — Sang Kim
(74) *Attorney, Agent, or Firm* — Alston & Bird LLP

(57) ABSTRACT

The invention relates to a reel-up (1) for receiving and winding into a roll (2) a paper web (W) that arrives from a drying cylinder in a paper making machine and for starting a new roll (2) from a tail (19) formed by cutting the paper web (W). The reel-up (1) comprises a rotatably mounted reel spool (3) onto which a paper web (W) can be wound to create a paper roll (2) of increasing diameter; and an endless flexible belt (4) mounted for rotation along a predetermined path of travel such that the flexible belt (4) forms a loop. The flexible belt (4) is positioned adjacent to the reel spool (3) to engage the paper web (W) against the reel spool (3) during winding such that the flexible belt (4) is deflected from the predetermined path of travel by an amount relative to the amount of paper material wound on the reel spool (3). A pair of water nozzles (14, 15) is arranged such that each water nozzle (14, 15) can direct a web-cutting water jet stream against the paper web (W) to cut the paper web (W) at a point before the paper web (W) reaches the flexible belt (4).
(Continued)

Each water nozzle (14, 15) is arranged to be movable in a direction which is transverse to the direction of movement of the paper web (W) and a glue nozzle (17) is arranged to direct a stream of glue against the reel spool (3) or against the tail (19). The invention also relates to a corresponding method for operating the reel-up.

7 Claims, 7 Drawing Sheets

(52) U.S. Cl.
CPC ..... *B65H 2301/51512* (2013.01); *B65H 2301/51534* (2013.01); *B65H 2801/84* (2013.01)

(56) References Cited

U.S. PATENT DOCUMENTS

| | | | | |
|---|---|---|---|---|
| 5,014,924 | A | 5/1991 | Nowisch et al. | |
| 5,183,442 | A | 2/1993 | Lefferts | |
| 5,251,835 | A | 10/1993 | Kyytsonen | |
| 5,360,179 | A | 11/1994 | Vesterinen et al. | |
| 5,404,653 | A | 4/1995 | Skaugen et al. | |
| 5,514,456 | A | 5/1996 | Lefferts | |
| 5,531,396 | A | 7/1996 | Kinnunen et al. | |
| 5,738,760 | A | 4/1998 | Svanqvist et al. | |
| 5,782,426 | A * | 7/1998 | Kinnunen ..... | B65H 18/22 242/526.3 |
| 5,901,918 | A | 5/1999 | Klerelid et al. | |
| 6,695,245 | B1 | 2/2004 | Schultz et al. | |
| 6,698,681 | B1 | 3/2004 | Guy et al. | |
| 6,743,334 | B2 | 6/2004 | Klerelid et al. | |
| 6,790,796 | B2 | 9/2004 | Smith et al. | |
| 6,797,115 | B2 | 9/2004 | Klerelid et al. | |
| 6,805,317 | B1 | 10/2004 | Andersson et al. | |
| 6,998,018 | B2 | 2/2006 | Klerelid et al. | |
| 7,112,258 | B2 | 9/2006 | Klerelid et al. | |
| 7,398,943 | B2 | 7/2008 | Horneck et al. | |
| 7,651,728 | B2 | 1/2010 | Payne et al. | |
| 7,896,034 | B2 | 3/2011 | Harwood et al. | |
| 8,167,229 | B2 | 5/2012 | Enwald et al. | |
| 8,871,060 | B2 | 10/2014 | Klerelid | |
| 2002/0139499 | A1 | 10/2002 | Berglund et al. | |
| 2003/0068948 | A1 | 4/2003 | Smith et al. | |
| 2003/0164199 | A1 | 9/2003 | Levine et al. | |
| 2003/0221807 | A1 | 12/2003 | Klerelid et al. | |
| 2006/0076116 | A1 | 4/2006 | Klerelid et al. | |
| 2006/0124268 | A1 | 6/2006 | Billings | |
| 2007/0003729 | A1 | 1/2007 | Harwood et al. | |
| 2007/0023561 | A1 | 2/2007 | Kemppainen et al. | |
| 2007/0075178 | A1 | 4/2007 | Hada et al. | |
| 2008/0050587 | A1 | 2/2008 | Billings | |
| 2008/0131652 | A1 | 6/2008 | Payne et al. | |
| 2008/0135195 | A1 | 6/2008 | Hermans et al. | |
| 2008/0318483 | A1 | 12/2008 | Salitsky et al. | |
| 2010/0051736 | A1 | 3/2010 | Enwald et al. | |
| 2010/0236656 | A1 | 9/2010 | Harwood et al. | |
| 2011/0146913 | A1 | 6/2011 | Harwood | |
| 2011/0151735 | A1 | 6/2011 | Harwood | |
| 2012/0024487 | A1 | 2/2012 | Quigley | |
| 2012/0024489 | A1 | 2/2012 | Quigley | |
| 2012/0267063 | A1 | 10/2012 | Klerelid et al. | |
| 2014/0130997 | A1 | 5/2014 | Klerelid | |
| 2016/0016745 | A1 | 1/2016 | Malmqvist et al. | |
| 2016/0031667 | A1 | 2/2016 | Klerelid et al. | |

FOREIGN PATENT DOCUMENTS

| | | | |
|---|---|---|---|
| CN | 1500058 | A | 5/2004 |
| CN | 01578858 | A | 2/2005 |
| CN | 101981252 | A | 2/2011 |
| CN | 102121167 | A | 7/2011 |
| CN | 102182097 | A | 9/2011 |
| DE | 10305606 | A1 | 8/2004 |
| DE | 102007055761 | A1 | 6/2009 |
| EP | 0658504 | A2 | 6/1995 |
| EP | 1538259 | A2 | 6/2005 |
| EP | 1741648 | A2 | 1/2007 |
| EP | 2354299 | A1 | 8/2011 |
| GB | 2423998 | A | 9/2006 |
| JP | 2001225336 | A | 8/2001 |
| KR | 1266781 | B1 | 5/2013 |
| WO | WO 97/48632 | A1 | 12/1997 |
| WO | WO 99/01363 | A1 | 1/1999 |
| WO | WO 2008/125723 | A1 | 10/2008 |
| WO | WO 2008/154214 | A1 | 12/2008 |
| WO | WO 2008/157223 | A1 | 12/2008 |
| WO | WO 2009/118450 | A1 | 10/2009 |
| WO | WO 2013/113110 | A1 | 8/2013 |
| WO | WO 2014/158071 | A1 | 10/2014 |
| WO | WO 2014/175808 | A1 | 10/2014 |

OTHER PUBLICATIONS

State Intellectual Property Office of the P.R.C., First Notification of Office Action for Application No. 201480047842.0, Sep. 2, 2016, 17 pages, China.

* cited by examiner

REEL-UP AND A METHOD FOR WINDING INTO A ROLL A PAPER WEB AND FOR STARTING A NEW ROLL

CROSS REFERENCE TO RELATED APPLICATIONS

This application is a National Stage Application, filed under 35 U.S.C. 371, of International Application No. PCT/SE2014/050893, filed Jul. 15, 2014, which claims priority to Swedish Application No. 1351034-2, filed Sep. 9, 2013, the contents of both of which are hereby incorporated by reference in their entirety.

BACKGROUND

Related Field

The present invention relates to a reel-up and a method for winding into a roll a paper web and for starting a new roll.

Description of Related Art

During winding of paper webs to rolls in a reel-up of a paper machine, the paper web that arrives from a drying cylinder in a paper making machine is caused to be wound on reel spools to form paper rolls. When a paper roll has been completed, newly arriving paper web must be caused to switch to a new reel spool such that a new paper roll can be wound on the new paper roll. This operation of changing to a new reel spool is known as turn-up.

Several different methods have been proposed for changing over between a completed reel and a new reel. One method that has been proposed to cut a narrow tail at one side of the web which tail is initially wound on the old roll. In this context, a "tail" means a narrow strip which has been cut from the paper web and which tail is narrower than the full width paper web. A new reel spool is moved towards the narrow tail and glue is applied to the narrow tail or to the reel spool such that the narrow tail is caused to adhere to the new reel spool whereafter the tail is widened to full width. When the tail is caused to adhere to the new reel spool, the tail is ripped off such that it is no longer wound onto the old paper roll. In this known method, the time lost for the change may typically be on the order of about 10-15 seconds. A disadvantage with this method is that the new paper roll will inevitably be somewhat thicker at that end of the new reel spool where the narrow tail is first caused to adhere. At the opposite end of the new reel spool, the paper web may become more loosely wound.

Another known method is to use reel spools that have been provided with adhesive tape in advance. A problem with this method is that the reel spools become more difficult to handle.

Another known method is "balloon blowing". Balloon blowing entails creating slack across the full width of the web by somewhat retarding the finished reel. With the aid of compressed air, the fold thus formed is then forced into the nip between the new reel shaft and the reel drum, after which the web is cut off. In order to increase the reliability of this type of reel switching, glue may also be applied to the reel spool or to the paper web. Experience has showed that the reliability of balloon blowing is low, in about 50%-60% of the cases, the switch is successful. When the operation is unsuccessful, a new attempt must be made.

Another method that has been suggested is to use a beam that supports glue nozzles distributed over the widths of the web. A solution in which glue nozzles are used is disclosed in U.S. Pat. No. 6,805,317.

Yet another known way of achieving turn-up is to cut the paper web by means of water jets. This method can take somewhat different forms but entails two water nozzles that are used to cut a narrow tail in the middle of the paper web and a nozzle for glue is used to apply glue to the new reel spool at the middle of the new reel spool where the narrow tail meets the new reel spool. The water nozzles are then moved toward the edges of the paper web such that the narrow tail is made wider and finally reaches full width. Examples of such a solution are disclosed in for example WO 97/48632 and U.S. Pat. No. 5,360,179. This method is sometimes referred to as "water jet turn-up".

In recent years, a new kind of reel-up has been suggested in which reeling is made against an endless flexible member instead of against a pressure roll. Such a reel-up is disclosed in for example U.S. Pat. No. 5,901,918 and reel-ups of this type have produced very good results, especially for tissue paper grades.

It is an object of the present invention to provide good solution for the turn-up operation in a reel-up in which winding is made against an endless flexible member, i.e. a reel-up of the kind disclosed in U.S. Pat. No. 5,901,918.

BRIEF SUMMARY

The present invention relates to a reel-up for receiving and winding into a roll a paper web W that arrives from a drying cylinder in a paper making machine and for starting a new roll from a tail formed by cutting the paper web W. The inventive reel-up comprises a rotatably mounted reel spool onto which a paper web W can be wound to create a paper roll of increasing diameter and an endless flexible belt mounted for rotation along a predetermined path of travel such that the flexible belt forms a loop. The flexible belt is positioned adjacent to the reel spool to engage the paper web W against the reel spool during winding such that the flexible belt is deflected from the predetermined path of travel by an amount relative to the amount of paper material wound on the reel spool. Two water nozzles are arranged such that each water nozzle can direct a web-cutting water jet stream against the paper web W to cut the paper web W at a point before the paper web W reaches the flexible belt such that a tail is created. Each water nozzle is arranged to be movable in a direction which is transverse to the direction of movement of the paper web W and a glue nozzle is arranged to direct a stream of glue against the reel spool and/or the tail. Preferably, the glue nozzle is a single nozzle which preferably is arranged to direct a stream of glue against the reel spool and/or against the tail at a point which is spaced from both axial ends of the reel spool. Most preferred, the glue nozzle is a single nozzle that is arranged to direct a stream of glue against the reel spool and/or against the tail at a point at the middle of the axial length of the reel spool, i.e. half-way between the axial ends of the reel spool.

In advantageous embodiments, a cutting device is arranged to divide the web in two equally wide parts. The cutting device is then arranged to act on the paper web W at a point which is upstream of the point at which the water jets are arranged to cut the paper web W.

The glue nozzle is preferably but not necessarily arranged to direct its stream of glue in a direction which is substantially parallel to the surface of the flexible belt in the area where the paper web W is engaged against the reel spool.

In advantageous embodiments of the invention, the reel-up may further comprise a deflection sensor mounted adjacent to the flexible belt and being arranged to measure the amount of deflection of the flexible belt from the predetermined path of travel. The reel-up may preferably further comprise an actuator for positioning the reel spool and the flexible belt relative to each other to vary the amount of deflection of the flexible belt. In such embodiments comprising a deflection sensor and an actuator, there is preferably a controller connected to the deflection sensor and the actuator for controlling the amount of deflection of the flexible belt as the paper roll increases in diameter.

In advantageous embodiments, the glue nozzle is arranged to be movable between an active position in which it is capable of directing a stream of glue against the reel spool (or against the tail) and a passive position away from the area of the reel spool.

The invention further relates to a method of winding a paper web to form a roll and for starting a new roll from a tail formed by cutting the web. The method comprises the steps of engaging an endless flexible belt against a reel spool, moving the endless flexible belt along a predetermined path of travel and rotating the reel spool such that the surface of the reel spool moves together with the flexible belt and forms a nip with the flexible belt. The inventive method further comprises the steps of receiving the paper web W onto the flexible belt and advancing the paper web W into the nip and directing the web W around the reel spool to form a roll of increasing diameter. The inventive method also comprises cutting the paper web by two water jets at a point before the paper web reaches the flexible belt such that a tail of paper is formed between the water jets, moving the water jets in a direction transverse to the direction of movement of the paper web and directing a stream of glue against the reel spool and/or against the tail.

In advantageous embodiments of the invention, the method optionally further comprises the steps of operating the reel-up in an initial phase in which the water jets are not active and activating a cutting device that cuts the paper web W web in two equally wide parts at a point which is upstream of the point where the water jets are arranged to cut the web such that the paper web W is divided in two parts as it reaches the flexible belt. The method may then comprise the additional steps of stopping the cutting such that an undivided web reaches the flexible belt and initiating cutting by means of the water jets at two points that are separate from each other in the direction transverse to the direction of movement of the paper web W such that the paper web W is cut in two side parts and one tail which is surrounded on both sides by the side parts. A stream of glue can then be directed against the reel spool and/or the tail and the water jets moved in a direction transverse to the direction of movement of the paper web such that the width of the tail increases until the tail has attained the full width of the paper web. Finally, the cutting device may be activated again such that the paper web W is one again cut in two parts.

BRIEF DESCRIPTION OF THE FIGURES

FIG. 2 is a schematic side view of a part of a reel-up of the type that the present invention relates to.

DETAILED DESCRIPTION OF VARIOUS EMBODIMENTS

Figure 1:
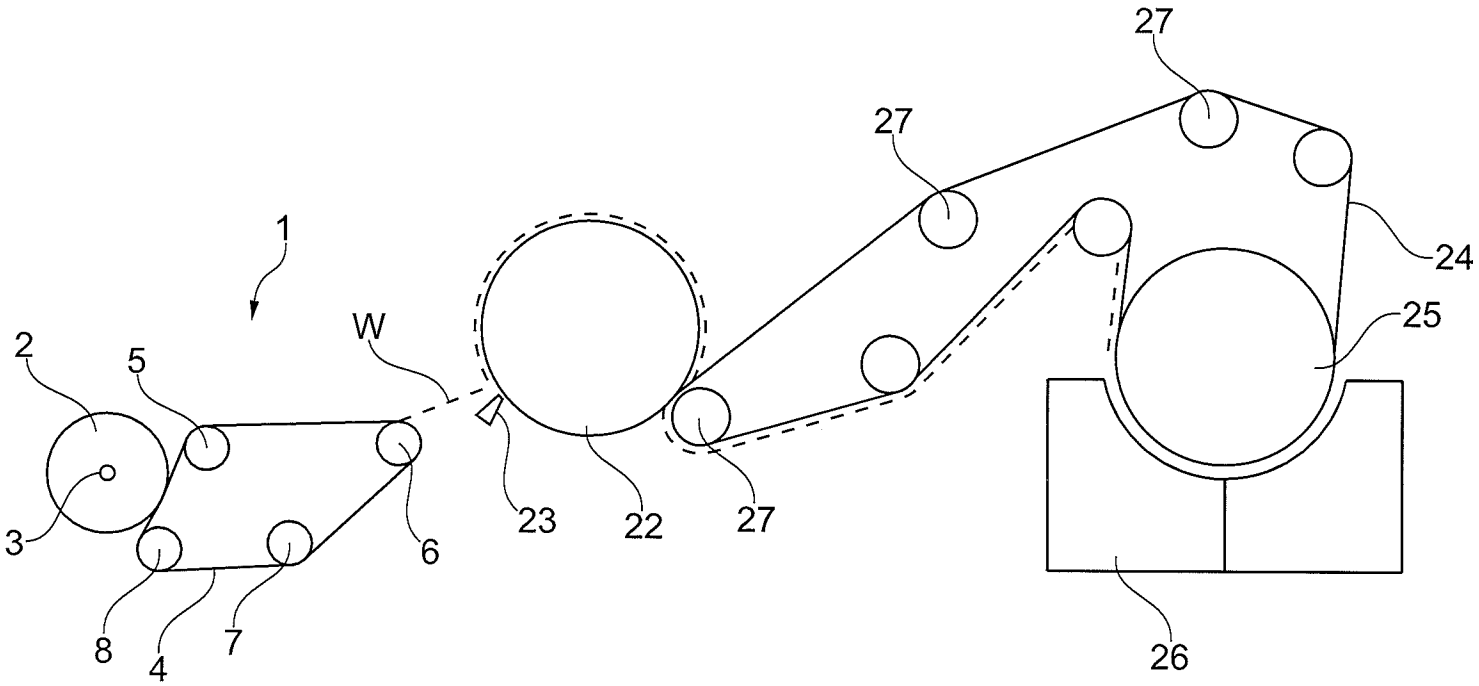
FIG. 1 is a schematic side view of a part of a paper making machine in which the inventive reel-up is used.

With reference to FIG. 1, a paper machine for making tissue paper is shown. The paper machine configuration shown in FIG. 1 is an example of a layout in which the present invention could be used but it should be understood that the present invention may also be used in other machines and that the layout of FIG. 1 is merely an example. In FIG. 1, a paper web W which has been formed in a forming section (not shown in FIG. 1) is passed on an air permeable TAD wire 24 over a through-drying cylinder 25 (i.e. a TAD cylinder 25). The reference numeral 26 refers to a hood. In operation, hot air may be passed from the inside of the TAD cylinder 25 and outwards through the TAD wire 24 and the paper web W. Optionally, air may instead pass from the hood 26, through the paper web W and the TAD wire 24 and into the TAD cylinder 25. The TAD wire runs in a loop supported by rolls 27. From the TAD wire 24, the paper web W is transferred to a drying cylinder 22 which may be a Yankee drying cylinder. The paper web W may be transferred in a nip formed between the drying cylinder 22 and a roll 27 inside the loop of the TAD wire 24. The paper web W is further dried on the drying cylinder 22 (which may be a Yankee cylinder which is internally heated by for example hot steam) from which it is taken off and passed to a reel-up 1. The Yankee cylinder may be, for example, a cast iron cylinder or, alternatively, a welded steel cylinder of substantially the same kind disclosed in EP 2476805. Optionally, a doctoring device 23 may be used to take the paper web W from the drying cylinder 22. The paper web W may be passed to the reel-up 1 along a path which ends with an open draw. Optionally, the paper web W can be supported by any known web-supporting device on a part of the way from the drying cylinder 22 or, optionally, along the entire path from the drying cylinder 22 to the reel-up 1. In the layout of FIG. 1, the web W passes in an open draw (i.e. unsupported) all the way from the drying cylinder 22 to the reel-up 1.

It will now be understood that the reel-up 1 is intended and arranged to receive and wind into a roll 2 a paper web that arrives from the drying cylinder 22. The reel-up 1 is also arranged to start a new roll from a tail when an old roll has reached its full size (diameter). As is known in the art, starting as new roll can be made by means of a tail formed by cutting the paper web W.

Figure 2:
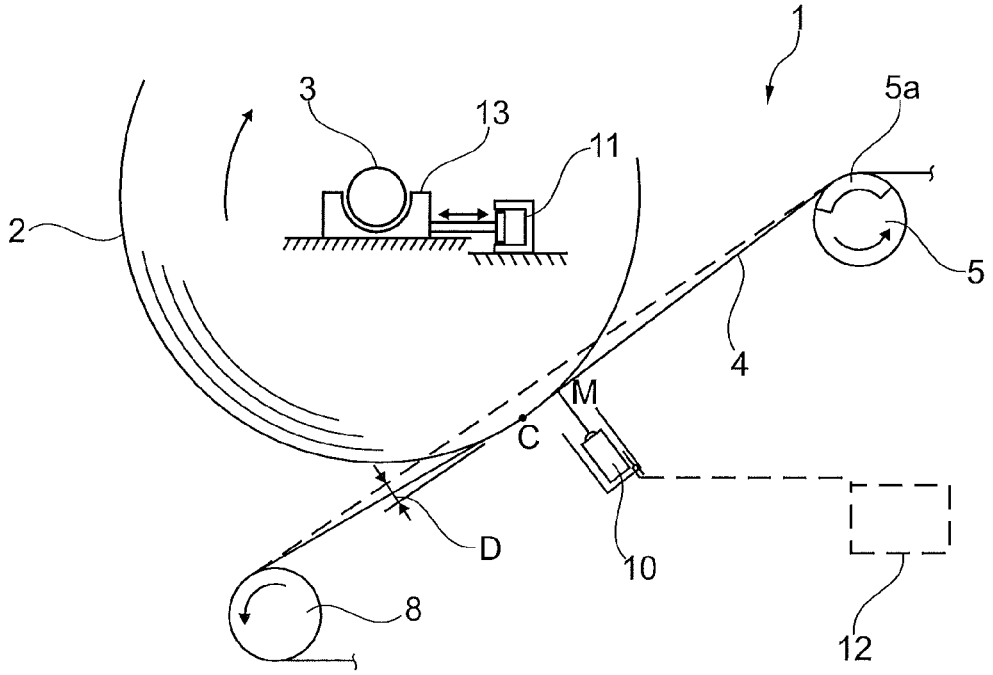

With reference to FIG. 1 and to FIG. 2, the reel-up 1 comprises a rotatably mounted reel spool 3 onto which a paper web W can be wound to create a paper roll 2 of increasing diameter. The reel-up 1 further comprises an endless flexible belt 4 mounted for rotation along a predetermined path of travel such that the flexible belt 4 forms a loop. The flexible belt 4 is positioned adjacent to the reel spool 3 to engage the paper web W against the reel spool 3 during winding such that the flexible belt 4 is deflected from the predetermined path of travel by an amount relative to the amount of paper material wound on the reel spool 3. An example of such a reel-up is known from U.S. Pat. No. 5,901,918 and the reel-up 1 of the present invention may be designed in such a way as to incorporate all features disclosed in that patent.

With reference to FIG. 2, the reel-up 1 may advantageously comprise a deflection sensor 10 mounted adjacent to the flexible belt 4 and arranged to measure the amount of deflection D of the flexible belt 4 from the predetermined path of travel. As more and more paper is wound on the reel spool 3, the diameter of the paper roll 2 will grow which may lead to an increased deflection D of the flexible belt 4 from its predetermined path of travel. As a consequence, the nip pressure in the nip C in FIG. 2 can increase which is undesirable because the paper web will not be wound evenly. To keep the pressure in the nip C constant, the reel-up 1 may be designed substantially according to U.S. Pat. No. 5,901,918. An actuator 11 may be arranged for positioning the reel spool 3 and the flexible belt 4 relative to each other to vary the amount of deflection of the flexible belt 4 and a controller 12 may be connected to the deflection sensor 10 and the actuator 11. The controller 12 which receives information about the deflection D from the deflection sensor 10 is arranged to control the actuator 11 such that the actuator 11 can act to move the reel spool 3 on which the paper web W is wound. The reel spool 3 is preferably rotatably mounted in a carriage 13 and the actuator 11 may be arranged to act on the carriage 13. It should be understood that each axial end of the reel spool 3 may be resting in such a carriage 13 and that there may be an actuator 11 acting at each axial end of the reel spool 3. The carriages 13 may be arranged to be movable along rails (not shown) such that the actuator(s) 11 will be capable of pushing the carriages 13 away from flexible belt 4 while the carriages 13 glide on the rails. The carriages 13 may optionally have wheels for rolling on the rails. The controller 12 may suitably be programmed to keep the deflection D at a predetermined level or to keep it within predetermined limits. If the deflection D of the flexible belt 4 becomes too large, the controller 12 will receive information about this from the deflection sensor 10. The controller 12 will then give a signal to the actuator (or actuators) 11 to act to move the reel spool away from the flexible belt 4. In this way, it is possible to control the amount of deflection D of the flexible belt 4 as the paper roll 2 increases in diameter. By controlling the amount of deflection D, the pressure in the nip C can be kept substantially constant.

When the paper roll 2 has reached its full size, the ready roll 2 is to be removed and a new roll started. This means that the paper web W must commence winding on a new reel spool 3, i.e. a turn-up operation must be performed.

To perform a turn-up operation, a suitable method for this kind of reel-up must be selected. In principle, balloon blowing could be used if the flexible belt 4 is sufficiently permeable to allow large quantities of air to be blown through the flexible belt 4. However, using a permeable belt is not always desirable. Moreover, even if the flexible belt 4 should have a degree of permeability, the permeability may still be unsatisfactorily low for the purpose of balloon blowing.

In principle, it could also be possible to use reel spools provided with adhesive tape. However, in addition to the usual difficulties in handling such reel spools, spools with an adhesive tape are difficult to use in connection with a flexible belt since such spools with an adhesive tape require a certain pressure between the web and the reel spool which may be difficult to attain with a flexible belt.

A reel-up using a flexible belt could also use a full-width turn-up solution with glue nozzles distributed over substantially the entire width of the paper web. Experience has showed that, by using this method, it is possible to achieve successful turn-up in the first attempt in about 80-85% of all cases which is considered good. However, for tissue grades, there is often a lot of dust in the air, especially if the paper web W has been creped from a Yankee cylinder. In an environment with lots of dust, the use of glue nozzles should be minimized since lumps of glue and dust may fall onto the web W and become a part of the paper roll.

For the above reasons, the inventor has found that the most suitable turn-up method for a reel-up with a flexible belt is to use the "water jet turn-up" method.

When the water jet turn-up method is to be used for a reel-up with a flexible belt, the water jets could in principle be directed towards the flexible belt such that the paper web W is cut while it is carried on and supported by the flexible belt. However, the inventor has found that the cutting by water jets should be performed before the paper web W reaches the flexible belt. The paper web W can easily be cut without a support. However, if the web is cut while carried by the belt, that might disturb the run of the belt in a way that could also disturb the web W in its path and result in a less exact cut. Moreover, cutting the web W while it is carried by the flexible belt 4 may cause undesirable wear on the flexible belt 4.

Figure 3:
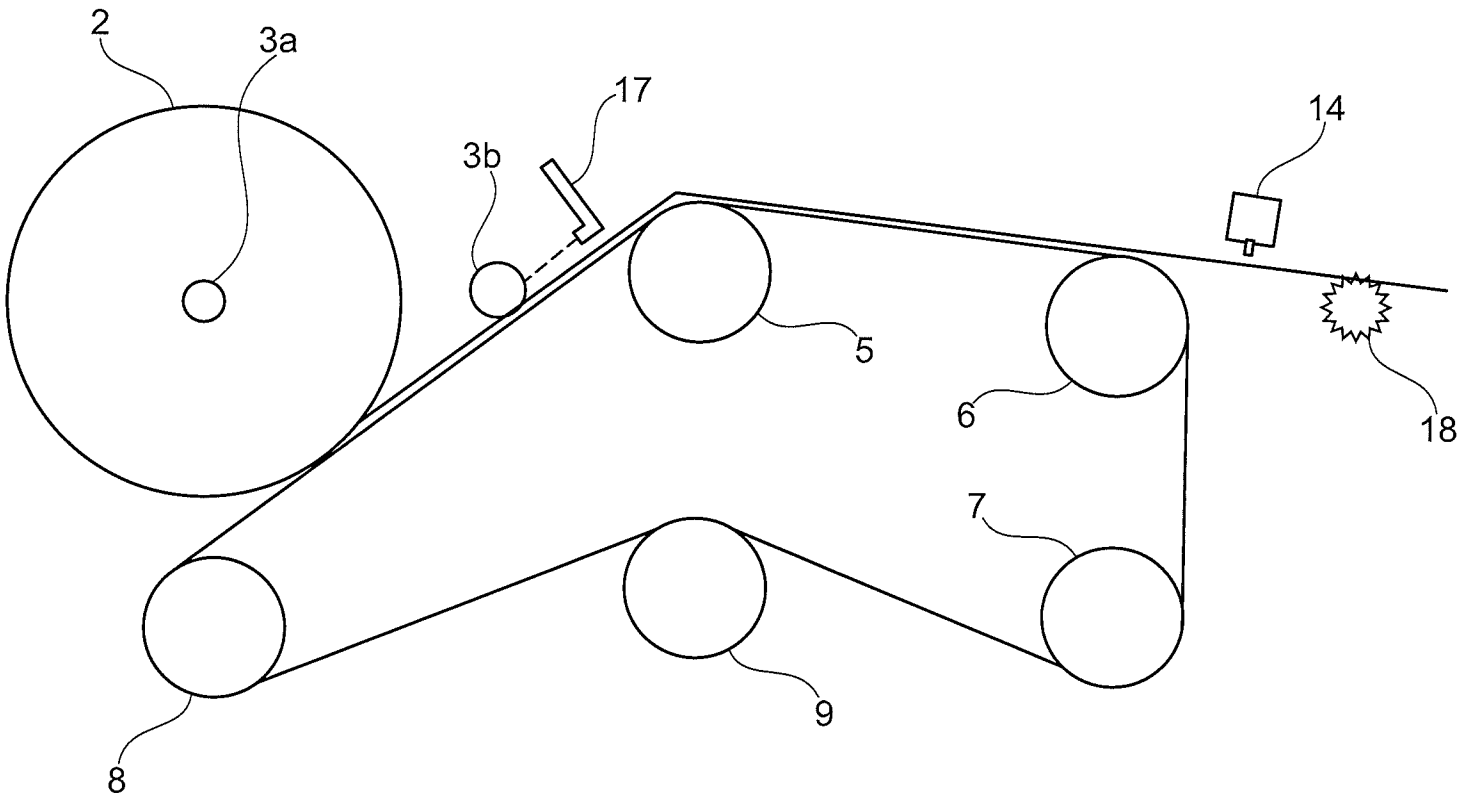
FIG. 3 is a schematic side view similar to FIG. 2 and showing further aspects of the invention.
Figure 4:
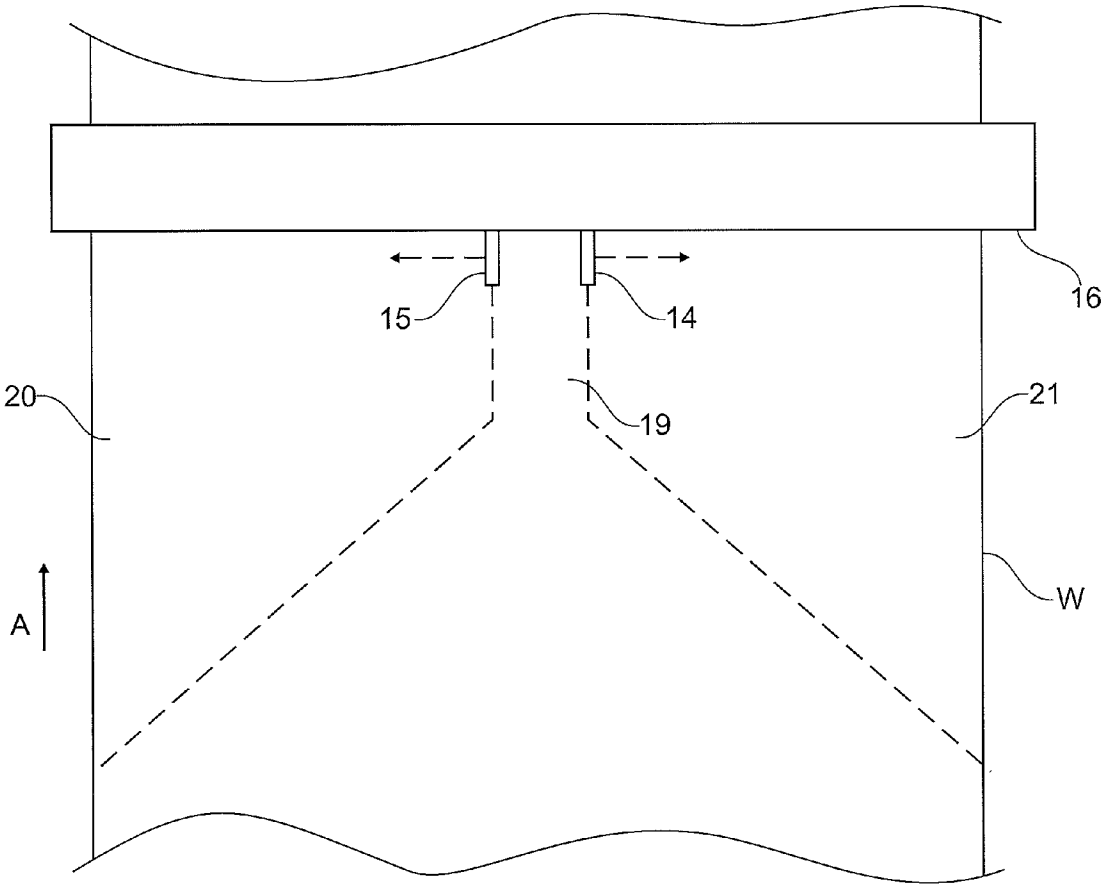
FIG. 4 is a view from above showing how a paper web is cut in connection with turn-up.

With reference to FIG. 3 and to FIG. 4, the inventive reel-up 1 comprises a pair of water nozzles 14, 15. The water nozzles 14, 15 are arranged such that each water nozzle 14, 15 can direct a web-cutting water jet stream against the paper web W to cut the paper web W at a point before the paper web W reaches the flexible belt 4. The paper web W will thus be cut by the water nozzles 14, 15 before it reaches the flexible belt 4. As can be seen in FIG. 4, each water nozzle 14, 15 is arranged to be movable in a direction which is transverse to the direction of movement of the paper web W. In FIG. 4, it can be seen how the water nozzles 14, 15 are mounted on a beam 16 such that they may move along the beam 16 although it should be understood that other means may also be used to carry the water nozzles 14, 15.

As can be seen in FIG. 3, a glue nozzle 17 is arranged to direct a stream of glue against a new reel spool 3. The glue nozzle 17 is preferably arranged to direct its stream of glue in a direction which is substantially parallel to the surface of the flexible belt 4 in the area where the paper web W is engaged against the reel spool 3. Alternatively, the glue nozzle 17 could be arranged to direct a stream of glue against a part of the paper web, i.e. against a tail.

The glue nozzle 17 is preferably a single glue nozzle arranged at a midpoint between the edges of the paper web W, i.e. it is arranged to act at the midpoint of the reel spool 3, between the axial ends of the reel spool 3.

If the glue nozzle 17 is a single glue nozzle 17, the risk that lumps of glue and dust are formed becomes smaller. However, embodiments with two or more glue nozzles 17 are conceivable.

If the glue nozzle 17 (possibly glue nozzles 17) is (are) arranged to direct its (their) stream of glue in a direction which is substantially parallel to the surface of the flexible belt 4, this can be used to make a rethread on a partially wound parent roll.

The glue nozzle 17 may advantageously be arranged to be movable between an active position in which it is capable of directing a stream of glue against the reel spool 3 (or the tail) and a passive position away from the area of the reel spool 3.

In an advantageous embodiment, a cutting device 18 may optionally be arranged to divide the web in two equally wide parts. Such a cutting device 18 should preferably (but not necessarily) be arranged to act on the paper web W at a point which is upstream of the point at which the water jets are arranged to cut the paper web W.

Initially, the basic function operation of the inventive reel-up shall now be explained with reference to FIG. 2. During normal operation, the endless flexible belt 4 is engaged against a reel spool 3 and the endless flexible belt 4 is moved along a predetermined path of travel. The reel spool 3 is rotated such that the surface of the reel spool 3 moves together with the flexible belt 4 and forms a nip with the flexible belt 4. A paper web W is received onto the flexible belt 4 and advanced into the nip C and directed around the reel spool 3 to form a roll 2 of increasing diameter. When the roll 2 has reached its full size, it must be removed and a new reel spool 3 must be put into operation.

The change of reel spool 3 will now be explained with reference to FIG. 3, FIG. 4, FIG. 5, and FIG. 6. As can be seen in FIG. 3, a paper roll 2 on an old reel spool 3*a* has reached its full size and a new empty reel spool 3*b* has been brought into position to receive the paper web and contacts the paper web on the flexible belt 4 but winding on the old reel spool continues 3*a*. As can further be seen in FIG. 3 and FIG. 4, water nozzles 14, 15 are arranged to cut the paper web W. During turn-up, the paper web W is cut by water jets coming from the water nozzles 14, 15 and the paper web W is cut at a point which is upstream of the flexible belt 4 in the direction of movement of the paper web. With reference to FIG. 4, the water nozzles 14, 15 are initially placed spaced apart from each other in the cross machine direction. When the water nozzles 14, 15 are activated, the water jets from the nozzles 14, 15 will then divide the paper web W in three parts. A tail 19 is thus formed in the middle, i.e. between the water jets. On each side of the narrow tail 19, there is a side part 20, 21 of the paper web W. The glue nozzle 17 is activated to direct a stream of glue against the new reel spool 3*b* or, alternatively, at the tail 19. Possibly, glue could be directed at both the new reel spool 3*b* and the tail 19. Embodiments are conceivable in which the glue nozzle 17 is arranged to eject a stream of glue in such a way that glue reaches both the new reel spool 3*b* and the tail 19. The glue nozzle 17 is located in a position which, in the direction across the width of the web, corresponds to the initial position of the water nozzles 14, 15, i.e. a position between the water nozzles 14, 15 in the direction across the width of the web (the cross machine direction). In this way, glue will be applied to the new reel spool 3*b* at a part of the new reel spool 3*b* that contacts the narrow tail 19. Alternatively, the glue nozzle 17 could be arranged such that the glue will be applied to the tail 19 such that the tail 19 will adhere to the new reel spool 3*b*. The narrow tail 19 will then start to get wound up on the new reel spool 3*b*. With reference to FIG. 4, the water nozzles 14, 15 are moved in the cross machine direction, i.e. in a direction that is transverse to the direction of movement of the paper web. When the water jets move, the tail 19 becomes wider. It should be understood that, in FIG. 4, the web is moving in the direction of arrow A. The arrow A thus indicates the machine direction and the water nozzles 14, 15 are arranged to move in the cross machine direction, i.e. transverse to the machine direction. In the embodiment of FIG. 4, the beam 16 on which the water nozzles 14, 15 are mounted also extends in the cross machine direction. When the water jets from the water nozzles 14, 15 are moved across the paper web W, the side parts 20, 21 will become narrower as can be seen in FIG. 4. When the water jets have reached the edge of the paper web W, the tail 19 has attained the full width of the web W and the paper web is now wound onto the new reel spool 3*b*. With reference to FIG. 6, it can be seen how a now completed roll 2 which is wound on its reel spool 3*a* is moved away from the flexible belt 4 while a new roll 2 has started to form on the new reel spool 3*b*.

Figure 5:
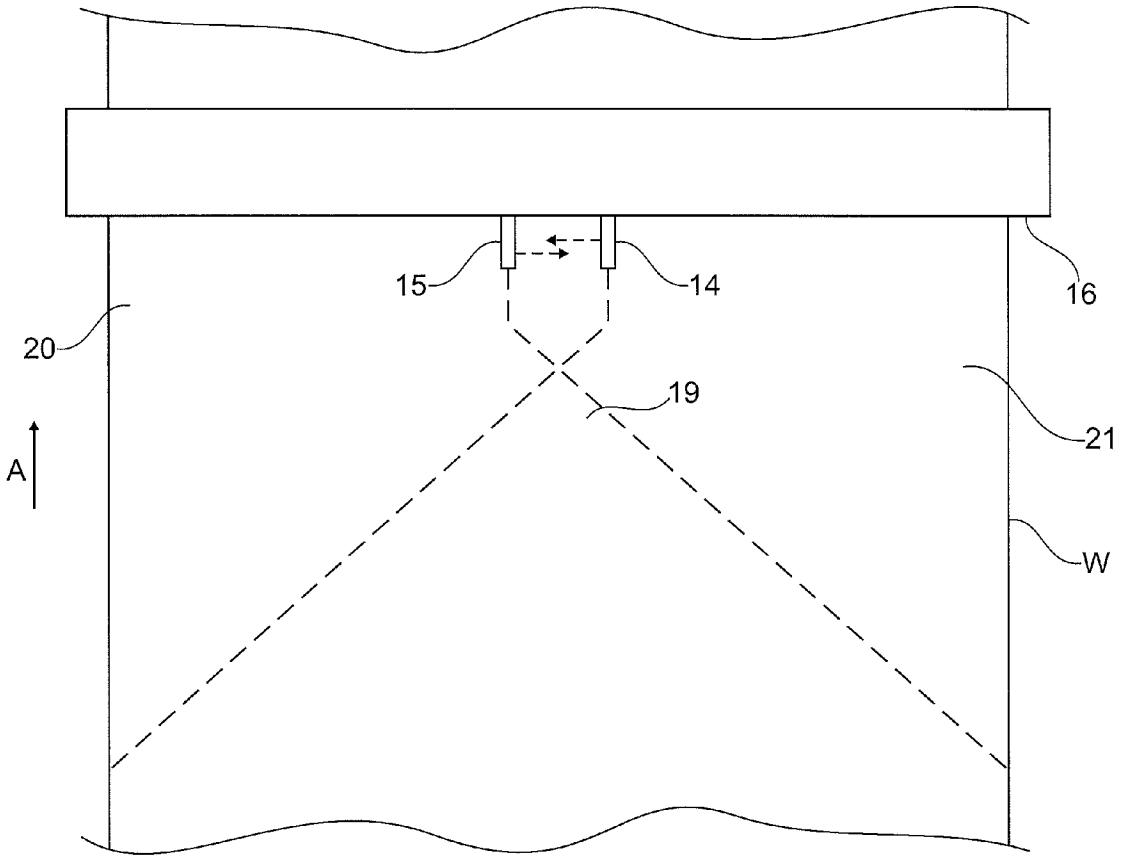
FIG. 5 is a view from above showing an alternative way of cutting a tail.
Figure 6:
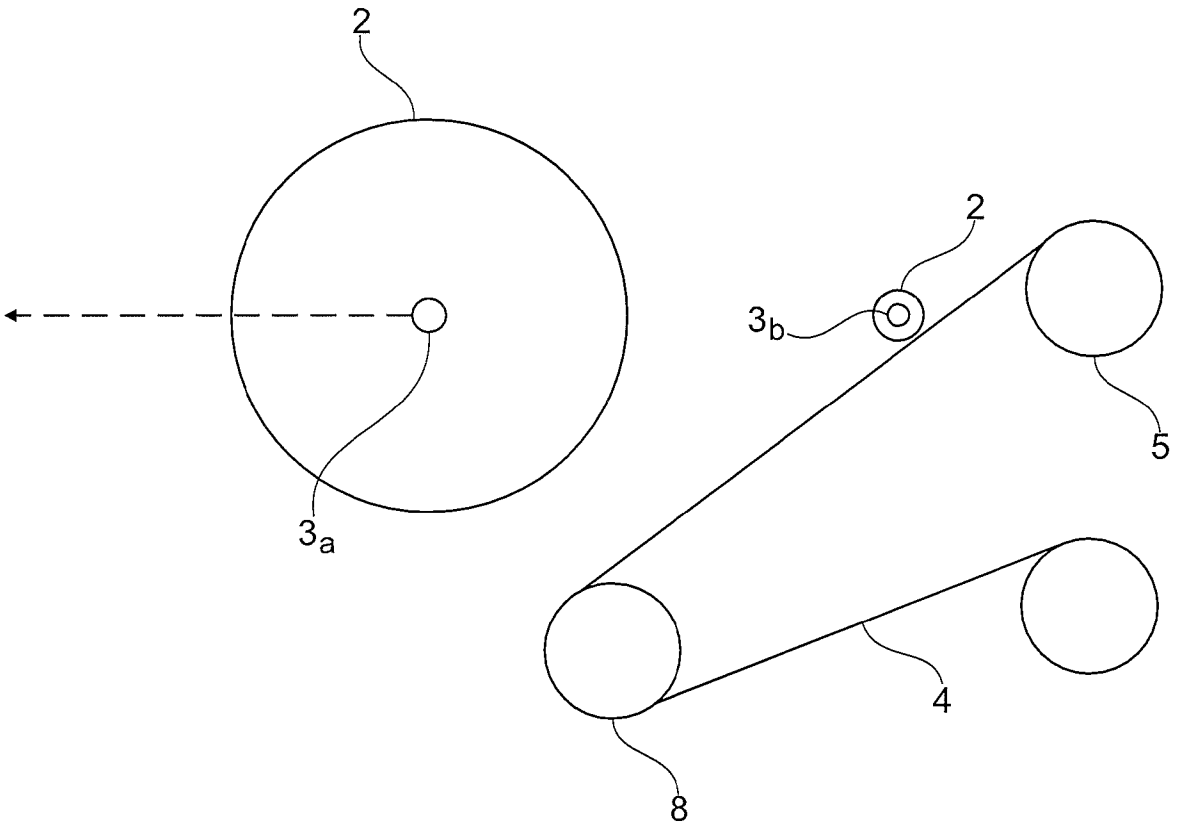
FIG. 6 is a schematic side view showing the situation immediately after turn-up.

FIG. 5 shows an alternative way of cutting the paper web W. In this embodiment, the water nozzles 14, 15 are moved in such a way that the water jets will cross each other which results in a different form of the tail. Otherwise, the function is the same as the one explained above with reference to FIG. 3, FIG. 4 and FIG. 6. It should be understood that, in FIG. 5, the web W moves in the direction of arrow A.

A possible way of achieving turn-up will now be explained with reference to FIGS. 7-10. Sometimes, it may be desirable to divide the paper web already before it is wound up on the reel spool 3. The reel spool 3 may optionally be provided with two separate cores (not shown in the figures). If the paper web W is divided before it reaches the reel spool 3, each core can receive its own separate part of the paper web W. To execute turn-up in such a case, the following procedure may be used.

In an initial phase, the water nozzles 14, 15 with their water jets are not active but the cutting device 18 is operated such that the paper web W is cut into two equally wide parts at a point which is upstream of the point where the water jets are arranged to cut the paper web W.

Figure 9:
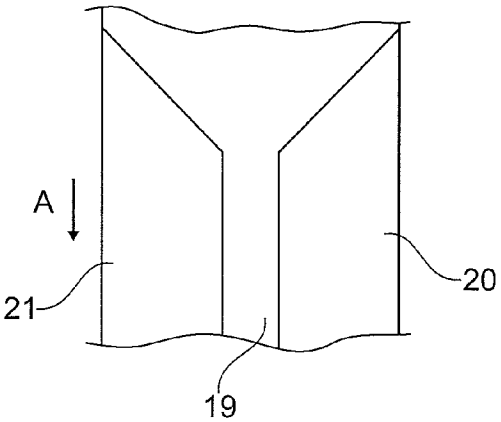
FIG. 9 is a view from above of a step that follows the step according to FIG. 8.
Figure 8:
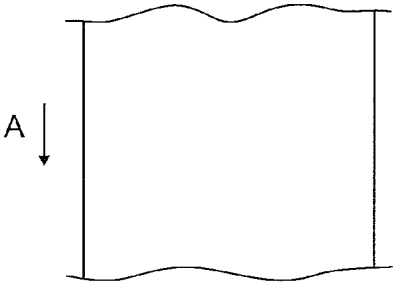
FIG. 8 is a view from above illustrating a step following the situation shown in FIG. 7.
Figure 10:
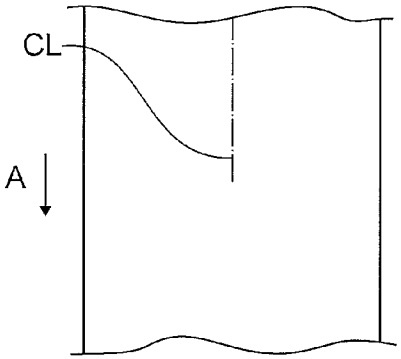
FIG. 10 is a view from above of a step that follows the step according to FIG. 9.
Figure 7:
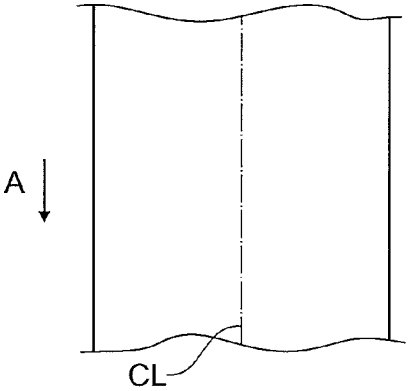
FIG. 7 is a view from above of the web before turn-up according to one embodiment of the invention.

The paper web W is thus divided in two parts as it reaches the flexible belt 4. In FIG. 7, it can be seen how the paper web W is divided by the cutting device 18 along the cutting line CL. The cutting device 18 is then deactivated such that the cutting is interrupted. With reference to FIG. 8, the paper web is now undivided and this undivided web will now reach the flexible belt 4. However, cutting by means of the water jets is now initiated at almost the same time such that the paper web W is cut by water jets at two points that are separate from each other in the direction transverse to the direction of movement of the paper web W. The paper web W will now be cut in two side parts 20, 21 and one tail 19 which is surrounded on both sides by the side parts 20, 21. This is illustrated in FIG. 9. As previously described, a stream of glue is directed against a new reel spool 3*b* or at the tail 19 and the water jets are moved in a direction transverse to the direction of movement of the paper web W. Thereby, the width of the tail 19 increases until the tail 19 has attained the full width of the paper web W. With reference to FIG. 10, the cutting device 18 is once again activated such that the paper web W is one again cut in two parts. It should be understood that, in practice, the water nozzles 14, 15 may be activated at substantially the same time as the cutting device 18 is deactivated.

By cutting the narrow tail at the middle of the paper web W instead of at the edge of the paper web W, the advantage can be obtained that the difference in thickness of the paper roll will not be so great in the axial direction of the reel spool 3.

By using the cutting device 18, to divide the web, a wide paper web may be made into two less wide rolls. The reel spool 3 may then optionally be divided in two separate parts.

Although the invention has been described in terms of a reel-up and a method of winding a paper web, it should be understood that these categories only reflect different aspects of one and the same invention. The method may thus comprise method steps that would be the natural consequence of using the inventive reel-up, regardless of whether such steps have been explicitly mentioned or not.

The invention claimed is:

1. A reel-up (1) for receiving and winding into a roll (2) a paper web (W) that arrives from a drying cylinder in a paper making machine and for starting a new roll (2) from a tail (19) formed by cutting the paper web (W), the reel-up (1) comprising:

a rotatably mounted reel spool (3) onto which a paper web (W) can be wound to create a paper roll (2) of increasing diameter; and an endless flexible belt (4) mounted for rotation along a predetermined path of travel such that the flexible belt (4) forms a loop, the flexible belt (4) being positioned adjacent to the reel spool (3) to engage the paper web (W) against the reel spool (3) during winding such that the flexible belt (4) is deflected from the predetermined path of travel by an amount relative to the amount of paper material wound on the reel spool (3), wherein:

a pair of water nozzles (14, 15) is configured such that each water nozzle (14, 15) can direct a web-cutting water jet stream against the paper web (W) to cut the paper web (W) at a point before the paper web (W) reaches the flexible belt (4) such that a tail (19) is created, each water nozzle (14, 15) is configured to be movable in a direction which is transverse to the direction of movement of the paper web (W), and a glue nozzle (17) is configured to direct a stream of glue against the reel spool (3) or against the tail (19).

2. The reel-up (1) according to claim 1, wherein a cutting device (18) is configured to divide the web in two equally wide parts, the cutting device (18) being configured to act on the paper web (W) at a point which is upstream of the point at which the water jets are arranged to cut the paper web (W).

3. The reel-up (1) according to claim 1, wherein the glue nozzle (17) is configured to direct its stream of glue in a direction which is substantially parallel to the surface of the flexible belt (4) in the area where the paper web (W) is engaged against the reel spool (3).

4. The reel-up (1) according to claim 1, wherein the reel-up further comprises:

a deflection sensor (10) mounted adjacent to the flexible belt (4) and configured to measure the amount of deflection of the flexible belt (4) from the predetermined path of travel;

an actuator (11) for positioning the reel spool (3) and the flexible belt (4) relative to each other to vary the amount of deflection of the flexible belt (4); and a controller (12) connected to the deflection sensor (10) and the actuator (11) for controlling the amount of deflection of the flexible belt (4) as the paper roll (2) increases in diameter.

5. The reel-up according to claim 1, wherein the glue nozzle (17) is configured to be movable between an active position in which it is capable of directing a stream of glue against the reel spool (3) and a passive position away from the area of the reel spool (3).

6. A method of winding a paper web (W) to form a roll and for starting a new roll (2) from a tail (19) formed by cutting the paper web (W), the method comprising the steps of:

engaging an endless flexible belt (4) against a reel spool (3);

moving the endless flexible belt (4) along a predetermined path of travel;

rotating the reel spool (3) such that the surface of the reel spool (3) moves together with the flexible belt (4) and forms a nip with the flexible belt (4); receiving the paper web (W) onto the flexible belt (4);

advancing the paper web (W) into the nip and directing the web (W) around the reel spool (3) to form a roll (2) of increasing diameter;

cutting the paper web (W) by two water jets at a point before the paper web (W) reaches the flexible belt (4) such that a tail (19) of paper is formed between the water jets;

moving the water jets in a direction transverse to the direction of movement of the paper web (W); and directing a stream of glue against the reel spool (3) or the tail (19).

7. The method according to claim 6, wherein the method further comprises:

operating the reel-up (1) in an initial phase in which the water jets are not active; activating a cutting device that cuts the paper web (W) web in two equally wide parts at a point which is upstream of the point where the water jets are arranged to cut the paper web (W) such that the paper web (W) is divided in two parts as it reaches the flexible belt (4);

stopping the cutting such that an undivided web reaches the flexible belt (4);

initiating cutting by means of the water jets at two points that are separate from each other in the direction transverse to the direction of movement of the paper web (W) such that the paper web (W) is cut in two side parts (20, 21) and one tail (19) which is surrounded on both sides by the side parts (20, 21);

directing a stream of glue against the reel spool (3) or the tail (19) and moving the water jets in a direction transverse to the direction of movement of the paper web (W) such that the width of the tail (19) increases until the tail (19) has attained the full width of the paper web (W); and activating the cutting device (18) again such that the paper web (W) is once again cut in two parts.

* * * * *